United States Patent [19]

Thomas

[11] Patent Number: 5,076,426

[45] Date of Patent: Dec. 31, 1991

[54] SNAP ACTION SWITCH

[75] Inventor: Joseph Thomas, Pelham, N.H.

[73] Assignee: Augat Inc., Mansfield, Mass.

[21] Appl. No.: 569,816

[22] Filed: Aug. 20, 1990

Related U.S. Application Data

[62] Division of Ser. No. 348,032, May 5, 1989, Pat. No. 5,006,680.

[51] Int. Cl.[5] ..... H01H 13/26

[52] U.S. Cl. ..... 206/330; 29/622; 200/459

[58] Field of Search ..... 29/622; 200/293, 303, 200/343, 408, 409, 459–461; 206/328, 330, 332

[56] References Cited

U.S. PATENT DOCUMENTS

| | | | |
|---|---|---|---|
| 4,044,212 | 8/1977 | Takano | 200/461 |
| 4,644,115 | 2/1987 | Nishimori et al. | 200/409 |
| 4,690,484 | 9/1987 | Oba et al. | 29/622 |
| 4,764,645 | 8/1988 | Takasawa | 29/622 |
| 4,818,726 | 4/1989 | Flaten | 206/332 |
| 4,860,436 | 8/1989 | Hirabayashi et al. | 29/622 |
| 4,887,347 | 12/1989 | Hikita | 29/622 |

FOREIGN PATENT DOCUMENTS

| | | | |
|---|---|---|---|
| 2813150 | 9/1979 | Fed. Rep. of Germany | 29/622 |
| 3047634 | 10/1981 | Fed. Rep. of Germany | 29/622 |
| 3629723 | 3/1987 | Fed. Rep. of Germany | 29/622 |
| 1-52351 | 2/1989 | Japan | 29/622 |

*Primary Examiner*—Jimmy G. Foster

*Attorney, Agent, or Firm*—Weingarten, Schurgin, Gagnebin & Hayes

[57] ABSTRACT

A snap action switch comprises a contact having a cut-out tongue mounted on a post with the tongue bent to form a spring, the post being one terminal. The other end of the element remote from the tongue end initially contacts an exposed second or third terminal above or below the other end.

When the actuator or nose from a resilient body acts against the surround adjacent the tongue end, force is exerted against the contact. As a result the contact snaps from the initial connection between the nose and one of the second or third contacts to the other. When the resilient body is relaxed to permit the nose to resume its original position, the switch snaps back to resume connection between the post the initial connection with the second or third terminal.

The disclosure includes an incipient form of the snap action switch; and also a method of making the incipient form and the switch.

2 Claims, 3 Drawing Sheets

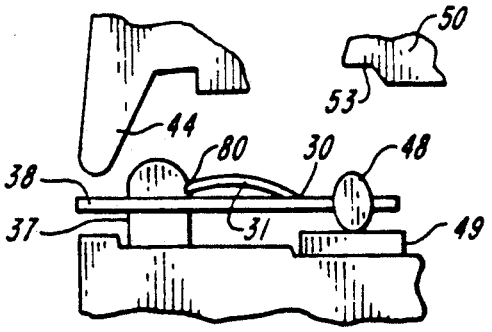
FIG. 4
FIG. 5
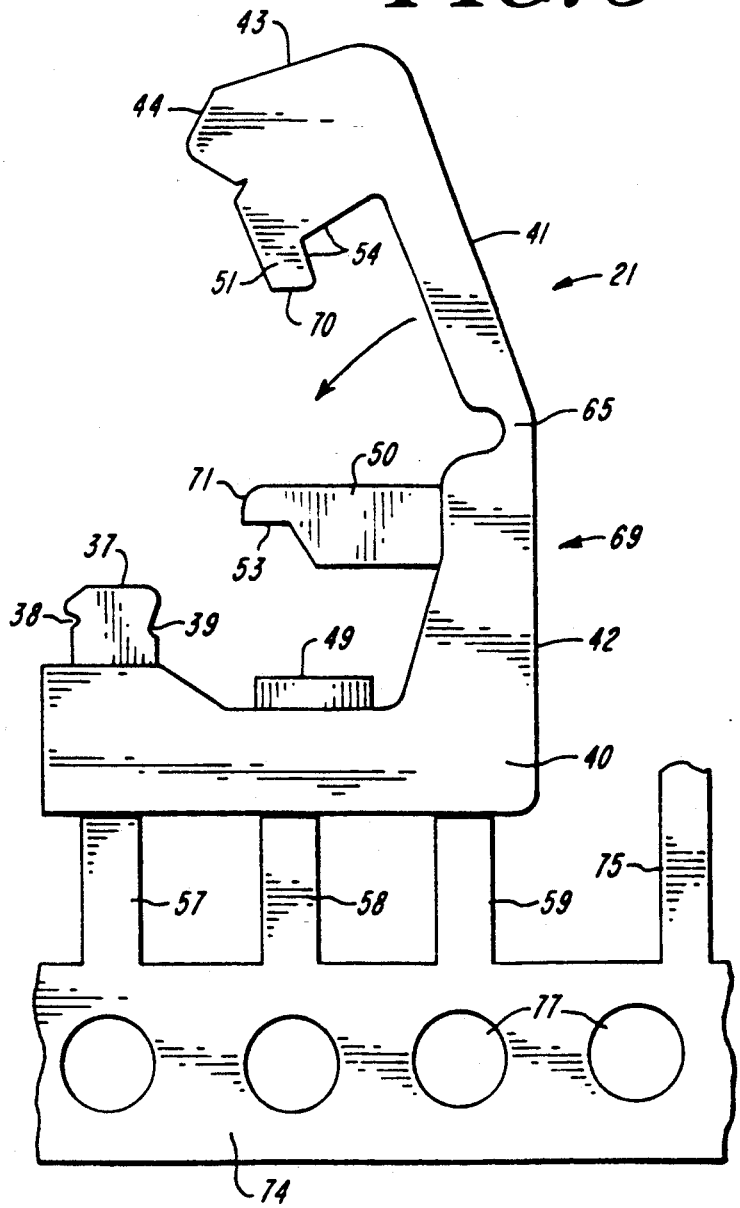

SNAP ACTION SWITCH

RELATED APPLICATION

This application is a division of my application Ser. No. 07/348,032, filed May 5, 1989, entitled "SNAP ACTION SWITCH", now U.S. Pat. No. 5,006,680.

FIELD OF THE INVENTION

The invention relates to switches, and more particularly to miniature precision snap action switches.

BACKGROUND OF THE INVENTION

Various patents describe snap action switches.

For example, U.S. Pat. No. 3,648,004 to Williams, III, Mar. 7, 1972, for Auxiliary Support Means for Electrical Switch Actuator describes a snap action switch biased to a first position. By depression of a plunger, the switch is actuated to a second position.

U.S. Pat. No. 3,700,843 to Resh, Oct. 24, 1972, for Snap-in Rigid Lever Actuating Arrangement, describes a rigid lever actuator which is snap fastened into place on an electrical switch base.

U.S. Pat. No. 3,809,837 to Yoshioka May 7, 1974, for Microswitch with Readily Removable Leaf Spring Actuating Means, describes a push button switch including an actuator. One portion of a spring is formed into a hook which engages a presented edge on the corresponding wall of a recess. This edge is preferably sharp to provide a fulcrum for bodily rocking movement of the actuator.

U.S. Pat. No. 3,811,024 to Sevigny May 14, 1974, Monetary Contact, Non-Bounce Switch describes a switch means carrying a weighted contact which may be biased away, is allowed to snap back to make a momentary electrical contact.

U.S. Pat. No. 3,832,508 to Beck, Aug. 27, 1974, for Micro-lever Switch Operator describes a lever which includes a portion for engagement with the operating plunger and a mounting portion having a forked extension with pivot arms.

U.S. Pat. No. 4,117,284 to Kirchoff et al. Sept. 26, 1978, describes a three position switch having a rocker, or see-saw movable contact.

U.S. Pat. No. 4,191,387 to Kirchoff for Watertight Seal for Toggle Switches, Mar. 4, 1980, relates to the seal for a toggle switch.

U.S. Pat. No. 4,254,310 to Kirchoff et al., Mar. 3, 1981, for Subminiature Multi-pole Toggle Switch with Linear See-saw Contact, shows a toggle switch reaching stable positions by virtue of a compression spring.

U.S. Pat. No. 4,295,017 to Kashima et al. Oct. 13, 1981, for Limit Switch describes an actuating arm 141 that is operated about a fulcrum to actuate a push button of a switch. A spring returns the lever to its normal position after actuation.

U.S. Pat. No. 4,306,132 to Henville, Dec. 15, 1981, for Electrical Switches describes a switch with an actuating lever for pivotal movement to actuate the switch.

U.S. Pat. No. 4,362,916 to Anderson, Dec. 7, 1982, for Miniature Precision Snap Action Switch Having Operating Lever Providing Large Overtravel uses one end 14*a* of a coiled bias spring 14 to bear against a bracket. The other end 14*b* is held against the riveted end of a cam 16 to bias the lever arm 12 and cam 16 counterclockwise until the tip 16*e* stops against the upper surface of a strip 8*c*.

U.S. Pat. No. 4,394,553 to Foil, July 19, 1983, describes a snap-action switch using a contact "trap mounted" to a terminal bracket. A lever may exert force on the spring to cause it to assume its other position. The spring contact returns when the lever is released.

SUMMARY OF THE INVENTION

According to the invention, in a snap acton switch a planar metallic body has a movable contact with a cutout tongue and a complete surround. The movable contact is mounted on a vertical conductive post with the post inserted between the tongue end and the surround end adjacent the tongue end to bend the tongue into a spring. A resilient insulating body holds two terminals, one above the other end of the element and the other below the other end of the element. The body has a nose which may be pressed against the surround adjacent the tongue end. When a force overcomes the resilience of the body to bring the nose down against the surround tongue end, the other member end is snapped from one terminal to the other terminal, breaking a connection from the post to the one, and making a connection from the post to the one. When the force is released, the initial connection is re-established.

In another aspect according to the invention, the resilient body includes an incomplete loop, which may have a lower side, an upper side, and a third side as complete loop sections, and another, incomplete side. The resilient body has the upper side latched to the complete side to retain the loop configuration. The post faces up from the incomplete side toward the nose on the incomplete side. The element makes contact between the post and between upper, or lower, contacts held by the body.

In another aspect according to the invention, the invention also includes an incipient form of the snap action switch which comprises a unitary integral body having a lower section and a side section, the side section being jointed to the lower section at a corner. When the corner is bent to bring the upper part of the side section over the lower section to form an upper section, the side section and the upper section are latched to form the switch.

In still another aspect according to the invention, the incipient snap action switch is made by processing forms in sequence between two parallel conductive strips, from which the contacts of the switch are developed.

DESCRIPTION OF THE DRAWINGS

The various objects, advantages, and novel features of the invention will be more fully apparent from the following detailed description when read in connection with the accompanying drawings, in which like reference numerals refer to like parts and in which:

FIG. 4 is a partial side view of another embodiment of the invention;

FIG. 5 is a side view of an incipient switch form under construction useful in explaining how the switch is made.

DETAILED DESCRIPTION OF THE PREFERRED EMBODIMENT

Figure 1:
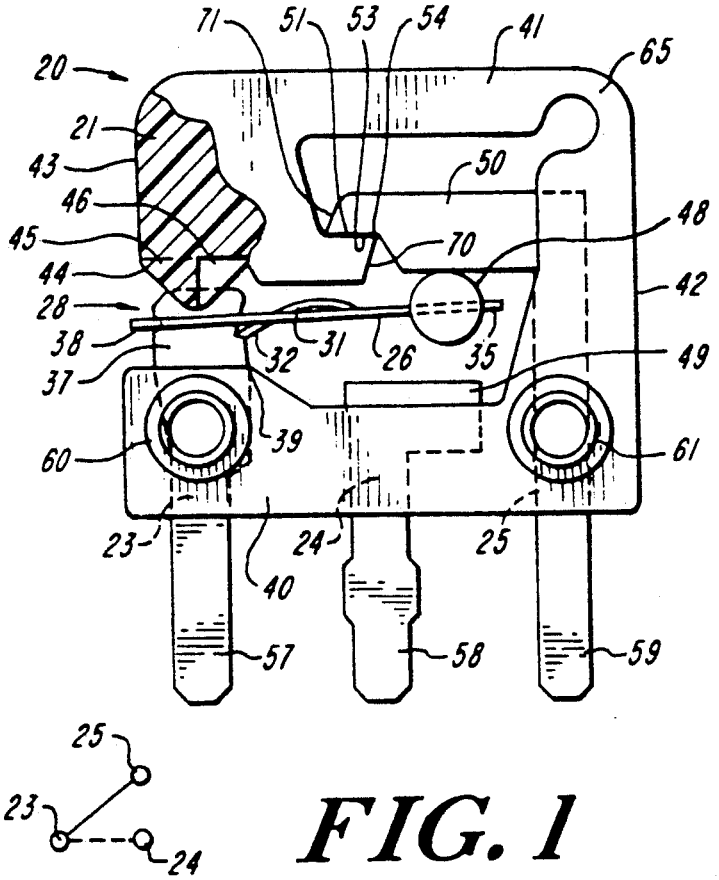
FIG. 1 is a side view of an embodiment of the invention and includes a conjoined small schematic electrical diagram of the operation of this switch.
Figure 3:
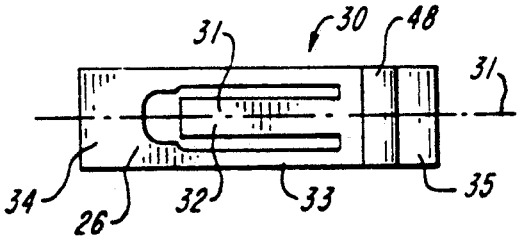
FIG. 3 is a top view of the movable contact.
Figure 2:
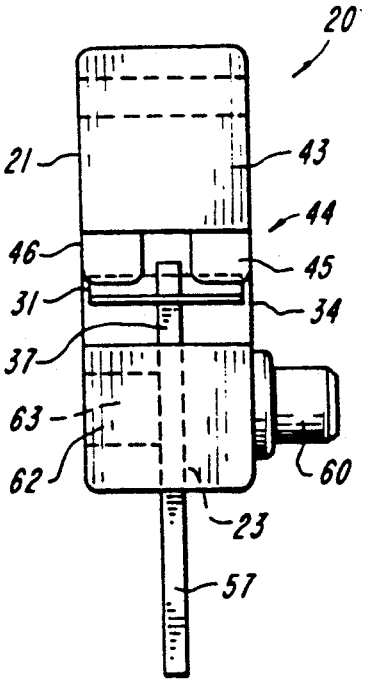
FIG. 2 is a front view of the embodiment of FIG. 1.

Referring to FIGS. 1-3 a snap action switch 20 comprises a unitary resilient insulating body or housing 21 having imbedded first, second and third terminals 23, 24, and 25, respectively. The body 21 is formed into a loop 27 incomplete at a gap 28, the resilience of the body 21 tending to open the loop 27 further at the gap 28.

A metallic member 30 may comprise a movable contact 26 and has a cut-out tongue 31 which has an end 32 and a surround 33. The member 30 has one longitudinal axial end 34 adjacent the tongue end 32 and another, axial, action free terminal end 35 at the other longitudinal axial end of the member 30 along the longitudinal axis 36. The longitudinal end 34 is adjacent the tongue end 32 is imbedded in a post 37 which is an exposed vertical extension up from the first terminal 23, with the post 37 inserted in the space between the end 32 of the tongue and the member, action end 35. So forcing the tongue 31 upon the post 37 causes the tongue 31 to bend into a spring, indicated also by the numeral 31. In order to definitely locate the tongue 31 on the post 37, the post is provided with a notch 38 on the outside of the post 37 with respect to the loop 27 which provides a fulcrum for the member 30, and a lower, inner notch 39 on the inside of the loop 27, so that the surround 33 lodges in the outer notch 38 to provide the fulcrum and the tongue end 32 lodges in the inner notch 37 to provide a force holding the spring 31 in bowed condition.

The loop 27 comprises a lower section 40, an upper section 41 and two side sections, one complete side section 42 and an incomplete side section 43. A nose contact 44 extends from the upper section 41 toward the lower section 40 and toward the member end 34 The actuator or nose 44 may be constructed in two parts 45, 46, so that when it presses down against the member end 34 adjacent the tongue 31, it exerts force equally and symmetrically on each side of the axis 36 and avoids the post 37, as shown in FIG. 2.

The metallic member 30 may include a cylindrical contact element 48 at the other, action end 35 of its longitudinal axis. The cylindrical element 48 has a horizontal axis parallel to the plane of the member 30, which is essentially planar. Although the form of the cylindrical element 48 is presently a preferred form, any contact element may be used, preferably of enough mass to provide a good "throw" to make a good contact as the element responds to the "snap" action, and if possible without "bounce". The second terminal 24 extends exposed at 49 from the body 21 lower section 40 below the action end 35, and the third terminal is exposed as a bar 50 cantilevered from the complete side section 42 inwardly of the loop 27 and toward the incomplete side 43 above the action end 35, of the member 30. A probe 51 from the upper part of the incomplete side section 43 latches with the bar 50 from the complete side section 42, the surfaces 53 and 54 affording the latching surfaces from bar 50 and probe 51 respectively.

The three terminals 23, 24, and 25, are connected respectively to three aligned connections 57, 58 and 59 which exit vertically respectively from below the body 21. A plurality of the switches 20 may be closely stacked horizontally and closely supported physically by means of a horizontal exposed connections 60 and 61 respectively to terminals 23 and 25, brought out at the lower part of the body 21. Further the exposed horizontal connections 60 and 61 may mate respectively with openings 62 and 63,(concealed behind 62 in FIG. 2) so that these terminals may be connected in parallel with the corresponding terminals of an adjacent switch, and at the same time afford physical support. If one wishes, the horizontal external connections 61 may be omitted and for example, the connections 60 may be retained as a ground connection, or as a power connection, or the other connection 61 may be retained as a ground connection omitting exposed connection 60.

A reduced thickness annular corner 65 between the complete, vertical side section 42 and the upper section 41 lends to the body 21, the resilience tending to swing the upper section 41 clockwise about the corner 65. This swing is restrained by the latch formed between the bar 50 and the probe 51 afforded by their respective latching surfaces 53 and 54 respectively. A camming surface 70 on the lower part of the probe 51, and camming surface 71 on the probe 51, when the upper section 41 is swung down about the annular corner 65, cams the bar 50 and probe 51 together to latch at the surfaces 53 and 54.

Figure 6:
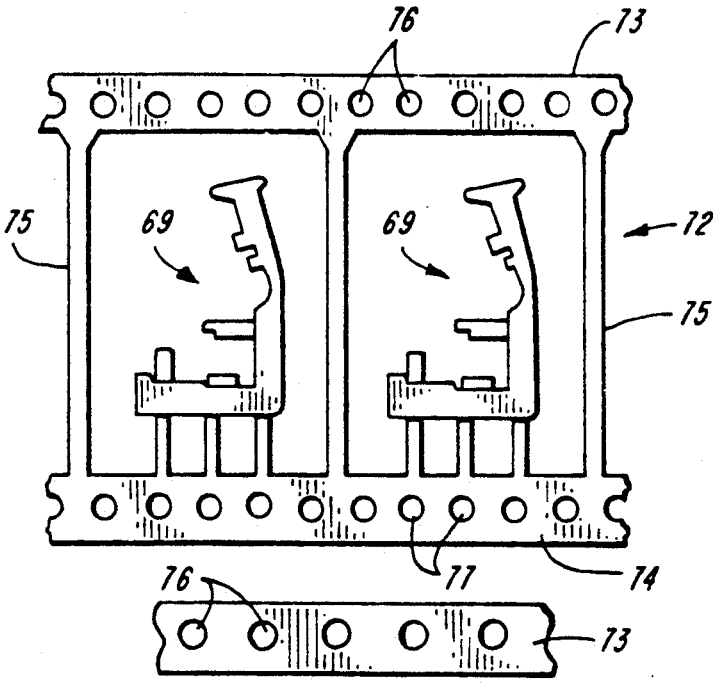
FIG. 6 is a side view of several of the switches of FIG. 5 under construction further useful in explaining how the switch is made.

The method by which the bodies are formed and latched will be more apparent from a consideration of FIGS. 5 and 6, in which a number of bodies 21 in a web 72 comprising an upper metallic conveyor strip 73, a lower metallic conveyor strip 74, and vertical conjoining metallic strips 75 which join the upper and lower parallel strips 73 and 74. Between each adjacent conjoining strip 75 is a resilient body 21. From the lower strip integrally extend connections 57, 58, and 59, respectively, which themselves are entered into the body to provide the terminals 23, 24, and 25. In short, the terminals are arranged and the bodies, preferably of a resin based material, are molded about the terminals 23, 24, and 25. The upper section 41 and the upper part of the incomplete section 43 in the incipient body are made in one vertical portion joined by an annular, concave inward, corner 65 of decreased thickness. Once the bodies 21 are formed, the members 30 may be appropriately placed on the posts 37. The bodies may then each be cut from the lower conveyor strip 74, bent or swung about the corner 65 until the camming surface 70 of each probe 51 cams the probe 51 over the camming suface 71 of the corresponding bar 50, and when released the latch is completed with the latching surfaces 53 and 54 joined. Registration apertures 76 on the upper strip 73 and apertures 77 on the lower strip 74 control the spacing of the conveyors as they are passed through automatic machinery for the forming of bodies 21, and the handling of the bodies after forming.

In operation of the embodiment of FIGS. 1, 2, and 3, when the nose is pressed down against the resilience of the body 21, particularly at the corner 65, the nose presses on front and back side of the post 37, but inward of the loop 27. The result is that there is a force against the member 30 inside the fulcrum afforded by the outer notch 38. The contact or cylindrical element carried at the action end 35 of the spring is initially and normally in contact with the upper bar 50, which is an exposed part of the terminal 25. When the nose presses on the member 30 inward of the loop 27, the force exerted causes a couple or turning moment about the fulcrum at outer notch 38 on the member 30. The clockwise turning moment ultimately is sufficiently great, that it overcomes the force holding the spring 31 against the upper terminal or bar 50 is overcome, and the spring 31 causes the action end 35 of the member 30 to snap down to make contact with the second exposed terminal at 49. As soon as the pressure of the nose against the member 30 is released, the action end 35 of the member 30 returns to its initial position, to which it is urged by the action of the spring 31, with the cylindrical element 48 again in contact with the exposed bar 50. The action is illustrated by the schematic electrical diagram conjoining FIG. 1 in which the solid line indicates the connection in the normal condition of the switch, and the dotted line indicates the connection when the nose is depressed.

If it is desired to have a snap action switch in which the initial condition is with the cylindrical contact element 48 in contact with the lower exposed part 59 of third terminal 25, the initial condition is adjusted accordingly. As illustrated in FIG. 4, the outer notch 38 should be above the inner notch 80 wherein is lodged the tongue end 32. The end of the nose 44 should be applied outside of the post 37 with respect to the loop 27. Otherwise the construction is substantially the same as for FIGS. 1-3. When the nose 44 in FIG. 4 is depressed against the surround 33 outside of and adjacent the fulcrum at the notch 38, a counterclockwise moment results about the fulcrum at notch 38. This moment causes the action end 35 of the member 30 to tend to move up and eventually to overcome the restraining force of its normal condition. The result in a snap action of contact 48 up to make contact with the bar 50 as the upper exposed portion of the terminal 25. On release the cylindrical element 48 snaps back to its initial condition. The action f the switch of FIG. 4 is illustrated by the schematic electrical diagram of FIG. 4 in which the solid line indicates the normal connection, and the dotted line indicates the connection to which the switch snaps when the nose is depressed. Naturally since the nose in this construction avoids the post in any event, it may be made simply in a single piece, as indicated in FIG. 4, and no division is required.

This construction illustrated by FIG. 4 is another form of the invention, although the form used may possibly be dictated by the desire to use a particular initial electrical condition, either the one illustrated in the conjoined schematic of FIG. 1 or the conjoined schematic of FIG. 4.

In making an incipient form 69 of the switch (see FIGS. 5 and 6) which may then be folded at the corner 65 to make either the switch of FIG. 1 or of FIG. 4, two parallel horizontal strips 73 and 74 are joined by strips 75. Accurately longitudinally spaced holes 76 and 77 in the respective upper and lower strips 73 and 74 respectively are used to step the strips to bring them to a molding station, where the mold is charged and incipient form 69 is molded between each adjacent pair of joining strips 75. The strips and molded forms may then be stepped to another station where the upper strip 73 is detached by cutting the strips 75, for example where they join the lower strip 74. Now the body may be stepped to another station where the exposed post 37 is notched as desired, depending on the form of the switch desired, that of FIG. 1 or FIG. 4. However, the post 37 may be pre-notched. At the next station the member 30 is attached to the post 37 and the spring 31 bent and fitted. At the next station the form 69 may be bent at the corner 65 so that the camming surfaces cam the sections 40 and 41 to latch the bar 50 and the probe 51. The remaining lower strip 74 may then be stepped to another station where the newly formed snap action switch may be separated from the lower strip 74 to leave the proper lengths of the connections 57, 58 and 59. This separation completes the construction of the switch.

From the foregoing description it is apparent that I have invented a new and useful snap action switch which may be extremely miniaturized. In one embodiment the dimensions of the body 21 left to right excluding the external connections was 0.275 inch, and top to bottom, excluding the external connections, was 0.250 inch, and the depth was only 0.090 inch. The stroke may be extremely short, such as less than 1/10th of an inch. Moreover, the snap switches of the invention are readily constructed, and operate repetitively and reliably. The construction and method of construction are novel and readily afford large volume production.

I claim:

1. A web for the production if incipient switch forms comprising:

a pair of parallel, longitudinal strips of metal equally spaced apart;

a plurality of incipient switch bodies, each body being a unitary, resilient insulating body, the strips being joined transversely between adjacent bodies;

first, second, and third terminals imbedded in the body;

first, second, and third contacts extending from the one strip to enter continuously and be part respectively of the terminals;

the body comprising a reduced thickness annulus-corner for folding into an incomplete loop, the reduced thickness annulus-corner concave inward when the body is latched into the loop, and a latch for latching the body when folded into the loop.

2. A web as claimed in claim 1, the strips having length indicia spaced at equal intervals longitudinally along the strips.

* * * * *